United States Patent [19]

Wadsworth et al.

[11] Patent Number: 4,540,097

[45] Date of Patent: Sep. 10, 1985

[54] CRANE WITH OUTBOARD COUNTERWEIGHT CARRIER

[75] Inventors: Charles Wadsworth, Escanaba; Dieter Juergens, Bark River, both of Mich.

[73] Assignee: Harnischfeger Corporation, Milwaukee, Wis.

[21] Appl. No.: 617,269

[22] Filed: Jun. 4, 1984

[51] Int. Cl.[3] ..... B66C 23/76

[52] U.S. Cl. ..... 212/196; 212/178; 212/198

[58] Field of Search ..... 212/191, 195–198, 212/156, 178

[56] References Cited

U.S. PATENT DOCUMENTS

| | | | |
|---|---|---|---|
| 2,068,397 | 1/1937 | Chapman | 212/198 |
| 3,842,984 | 10/1974 | Brown et al. | 280/103 X |
| 3,930,583 | 1/1976 | Jouffray | 212/195 |
| 4,042,115 | 8/1977 | Beduhn et al. | 212/178 |
| 4,170,309 | 10/1979 | Lampson | 212/198 |
| 4,243,148 | 1/1981 | Lampson | 212/196 |
| 4,258,852 | 3/1981 | Juergens | 212/178 |
| 4,280,627 | 7/1981 | Becker | 212/198 |
| 4,316,548 | 2/1982 | Helm et al. | 212/196 |
| 4,349,115 | 9/1982 | Lampson | 212/178 |
| 4,382,519 | 5/1983 | Beduhn et al. | 212/195 |

FOREIGN PATENT DOCUMENTS

| | | | |
|---|---|---|---|
| 2071051 | 9/1981 | United Kingdom | 212/196 |
| 320443 | 1/1972 | U.S.S.R. | 212/195 |

*Primary Examiner*—Trygve M. Blix
*Assistant Examiner*—R. B. Johnson
*Attorney, Agent, or Firm*—James E. Nilles

[57] ABSTRACT

Disclosed is a crane wherein a trailer-like counterweight carrier has a horizontal motion transmitting connection with a platform which is swivelably mounted on a crane base and which supports the boom and the mast of the crane. Guy connections between the counterweight carrier and the top of the mast and between the mast and the boom translate forward tilting force that a lifted load imposes upon the boom into lifting force on the counterweight carrier. A lost motion connection between the counterweight carrier and the platform comprises rigid members. It allows the carrier to be lifted to a predetermined height above the ground and at that point imposes upon the crane chassis further lift force upon the counterweight carrier, so that the crane base cooperates with the counterweight in resisting forward tilting of the boom under heavy loads. The lost motion connection requires no adjustment to adapt it for different loads and different inclinations of the boom and mast.

3 Claims, 4 Drawing Figures

CRANE WITH OUTBOARD COUNTERWEIGHT CARRIER

FIELD OF THE INVENTION

This invention relates to cranes of the type having an outboard wheel-mounted counterweight carrier, and the invention is more particularly concerned with a load transferring connection between the counterweight carrier of such a crane and the swivelable deck that carries the boom of the crane, the hoisting machinery and the operator's cab.

BACKGROUND OF THE INVENTION

When a counterweight is attached to a crane in order to enable the crane to lift heavy loads, certain problems arise that have not heretofore been satisfactorily solved.

Ordinarily a crane to which a counterweight is applied comprises an earthborne base or understructure on which a platform or crane deck is mounted for swiveling about a vertical axis; and the platform, in turn, supports a generally upright boom which is swingable back and forth in a vertical plane about a horizontal axis that extends through or near the vertical swiveling axis. A load lifting line that passes over the upper end of the boom and normally depends from it is connected with a power driven winch on the platform.

Since the boom normally has a forward inclination, the lifting of a heavy load tends to tilt the crane forward, and a large enough load could tip it over. Counterweights in one form or another are often employed to resist these tilting forces.

The simplest form of counterweight is one that is rigidly attached to the platform, either on a rearwardly extending portion of the platform itself or on a rigid arm projecting rearwardly from it. The disadvantage of a rigid connection between a very heavy counterweight mass and the platform is that when the crane is unloaded, the counterweight imposes high tilting stresses upon the swiveling connection between the platform and the crane base.

To avoid this disadvantage, counterweight carriers on castered wheel carriages have been connected to the platform, to swing with the platform as it swivels and to ride back and forth with the entire crane when the crawler treads are driven. Because such a mobile counterweight is supported by the surface that its wheels engage, it imposes no tilting force on the swivel joint for the platform when the crane is unloaded.

U.S. Pat. No. 4,258,852, to D. C. Juergens, discloses counterweight carriers connected with the platform by rigid rearwardly extending arms that can swing up and down relative to the platform about a horizontal axis which passes close to the vertical swiveling axis. Through guy lines extending from the top end of the boom to the counterweight carriers, the boom is stabilized by the oppositely directed forces of the load and the counterweights. The counterweight carriers are at all times in contact with the surface underlying them, owing to the pivoted connection between the counterweight carrier arms and the platform, which allows the carriers to move up and down relative to the rest of the crane as they pass over small irregularities in the surface on which they ride. Hence, the counterweights do not impose any tilting force upon the swivel connection between the platform and the crane base at times when the crane is not supporting a load. However, this arrangement has the disadvantage that forward tilting forces on the boom are supported only by the counterweights, and therefore, the counterweight moment must always be large enough to offset the largest moment that will be imposed on the tip of the boom by a load to be lifted. A heavy counterweight and a long arm, needed for a very heavy load, impede and complicate the swiveling movements of the crane when it is hoisting a light load, and therefore this arrangement requires time consuming adjustments for adapting it to different loads.

U.S. Pat. No. 3,842,984, to Brown et al, discloses a counterweight carrier mounted on wheels and connected with the platform by means of arms that are swingable up and down, essentially as in the above described arrangement; but provision is made for adding the stabilizing forces of the crane base to those provided by the counterweight when the counterweight, by itself, would be too light to support tilting forces on the boom. In Brown et al, the boom projects from the platform at a forward inclination, and behind it is a mast that projects up from the platform at a rearward inclination. An adjustable line linkage connects the tips of the mast and the boom, and from the tip of the mast a second adjustable line linkage is connected to a gantry on the platform. The second linkage, when taut, can carry forward tilting force on the boom and the mast into the platform and the crane base, but normally it is slack and does not do so. Instead there is a third adjustable line linkage, connected between the tip of the mast and the counterweight carrier, whereby forward tilting force upon the boom is initially imposed upon the counterweight carrier. Thus, if the hoisted load is heavy enough, the counterweight carrier is lifted off of the ground. As it rises, allowing the mast to swing forward, the second linkage is tensioned, so that when the counterweight carrier has been lifted up off the ground to a certain extent the forward tilting forces generated by the load are imposed upon the platform through the mast and the second linkage. Obviously the success of this arrangement depends upon proper adjustment of the second and third linkages. If too much slack is left in the second linkage, the boom can swing too far forward as the counterweight rises and can reach a position at which the load moment at its tip will exceed the sum of the offsetting forces exerted by the counterweight and the crane base.

As explained in U.S. Pat. No. 3,842,984, it has also been proposed (U.S. Pat. No. 3,037,643) to mount a counterweight on a rearwardly projecting portion of the platform that is supported on a castered wheel arrangement. Although the counterweight is supported on its wheel assembly when the boom is not loaded, and at all times cooperates with the main chassis or crane base to resist tilting forces imposed by a load on the boom, the arrangement has the important disadvantage that all stresses due to irregularities in the surface that supports the counterweight wheel assembly will be imposed upon the swiveling connection between the platform and the crane base.

SUMMARY OF THE INVENTION

The general object of this invention is to provide a crane having an outboard counterweight carrier that has all of the advantages of the above discussed arrangements but none of their disadvantages.

More specifically, it is an object of this invention to provide a crane having a counterweight carrier that is mounted on wheels and therefore does not impose tilting forces upon the swivel connection between the crane base and the platform at times when no load is being lifted by the crane; wherein the counterweight carrier is so connected with the platform that it is constrained to move horizontally with the platform but can move up and down relative to it to accommodate irregularities in the surface traversed by its wheels; wherein the counterweight carrier is so connected with the boom of the crane that forward tilting forces on the boom are translated into lifting forces upon the counterweight; and wherein a lost motion connection between the counterweight carrier and the platform automatically brings the crane base into cooperation with the counterweight to support tilting forces on the boom when a very heavy load has lifted the counterweight carrier to a predetermined height.

Another general object of the invention is to provide a crane that has markedly improved operating efficiency, in that it is capable of hoisting successive loads that vary widely in weight without needing adjustments to its structure between hoists for adapting it to different loads.

BRIEF DESCRIPTION OF DRAWINGS

In the accompanying drawings, which depict what is now regarded as a preferred embodiment of the invention.

DETAILED DESCRIPTION OF PREFERRED EMBODIMENT OF THE INVENTION

Figure 1:
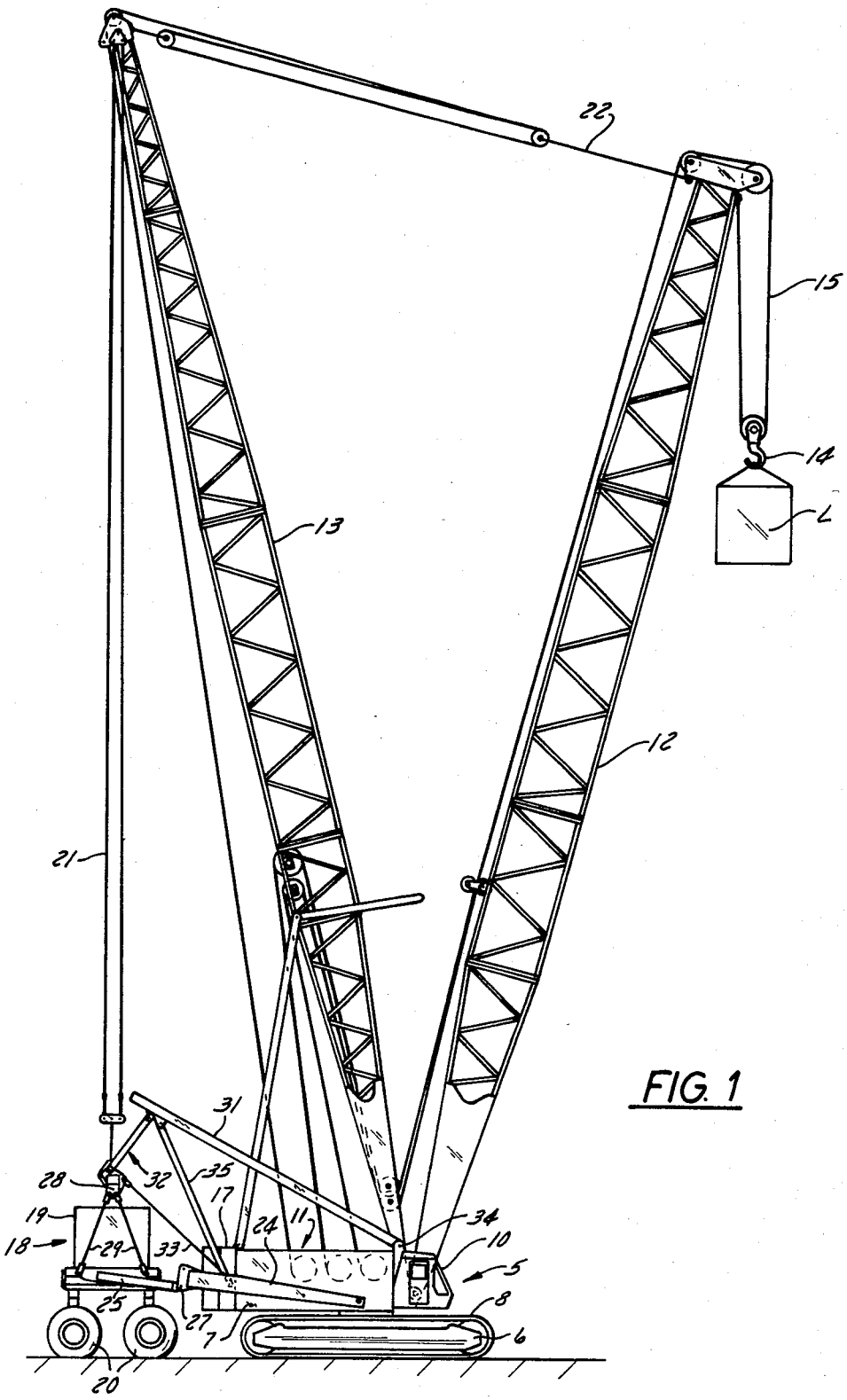
FIG. 1 is a view in side elevation of a crane embodying the principles of this invention.
Figure 2:
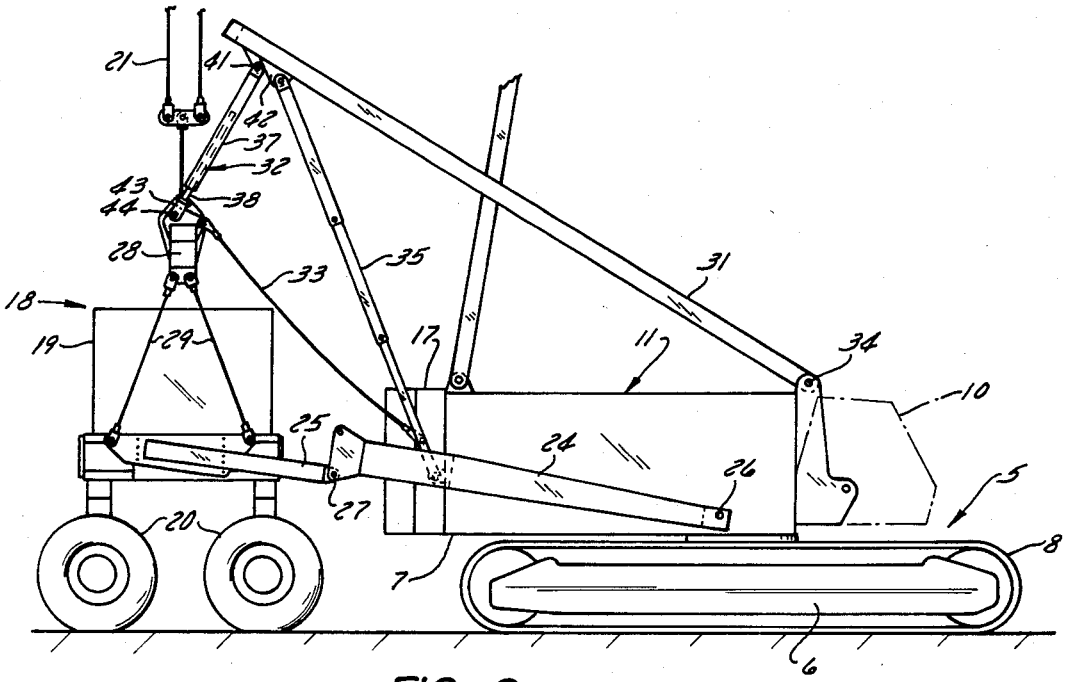
FIG. 2 is a detail view in side elevation, showing the crane chassis and the counterweight carrier under conditions of no load or a light load on the crane.

A crane of this invention has a main chassis 5 that comprises an earthborne base or understructure 6 upon which a platform or crane deck 7 is mounted to swivel about a vertical axis. In this case, the crane base 6 is mounted on endless crawler treads 8 that give the crane mobility for horizontal transport of a hoisted load. The crawler treads 8 are laterally spaced apart by a substantial distance and they extend substantial distances in front of and behind the vertical swiveling axis, to thus provide for stable earthborne support of the superstructure of the crane whereby tilting forces are resisted to a substantial extent.

Mounted on the platform or crane deck 7 to swivel with it are an operators' cab 10, conventional hoisting machinery 11 that comprises an engine and winches, a load supporting boom 12 and a mast 13. The boom 12 has a pivotal connection to the platform 7 that defines a horizontal axis, near the vertical swiveling axis, about which the boom swings in a vertical plane. Through the range of its normal swinging motion the boom projects upwardly from the platform 7 and away from the swiveling axis in a forward direction. The mast 13 has a pivotal connection to the crane deck that is rearwardly adjacent to the boom connection, and the mast can swing in the same vertical plane as the boom, but it normally projects up from the platform at a more or less rearwardly oblique angle.

As is also conventional, a load line 15 that passes over the upper end of the boom 12 and normally depends therefrom is connected with one of the winches of the hoisting machinery 11. The load line carries a hook 14 or the like for supporting a load L to be hoisted.

Fixed on the platform 7 is a conventional counterweight 17 which is spaced a substantial distance to the rear of the vertical swiveling axis and which offsets the tilting forces imposed upon the swivel connection by the weight of the boom itself.

Spaced to the rear of the platform 7 is a trailer-like counterweight carrier 18 which supports a relatively massive counterweight 19 and which is mounted on wheels 20 that are arranged in a known manner for swiveling or castering. The counterweight carrier 18 has a first connection with the platform 7, described hereinafter, whereby the counterweight carrier is allowed to move up and down relative to the platform but is maintained at a fixed distance behind the platform and is constrained to partake of all horizontal motion of the platform, both in swiveling and in translation. A pendant 21 connects the upper end of the mast 13 with the counterweight carrier 18, and an adjustable guy line 22 connects the upper end of the mast with the upper end of the boom, so that through these lines 21 and 22 the forward tilting forces that a load exerts on the boom are carried into the counterweight carrier 18 and translated into a lifting force upon it.

The above mentioned first connection between the counterweight carrier 18 and the platform 7 comprises a pair of rearwardly extending arms 24 on the crane deck or platform, one at each side of it, and a pair of forwardly extending arms 25 that are fixed to opposite sides of the counterweight carrier. At their front ends the arms 24 on the crane deck or platform have coaxial pivot connections 26 to the platform that define a horizontal axis which is near the vertical swiveling axis and about which the rear ends of the arms 24 are swingable up and down. At their rear ends the arms 24 have coaxial pivot connections 27 to the front ends of the arms 25 on the counterweight carrier. By reason of the two sets of pivotal connections 26, 27, the counterweight carrier maintains an unchanged attitude as it is lifted off of the ground and lowered back onto it by changing forces on the upper end of the boom.

The pendant 21 exerts its lifting forces upon the counterweight carrier through a stabilizing connection that comprises a lifting beam 28 which extends sidewardly across the counterweight carrier at a level above the counterweight 19 and to which the pendant 21 is attached. Each end of the lifting beam 28 is connected with its adjacent side of the counterweight carrier by means of a pair of tension cables 29 that extend divergingly downward from the lifting beam to attachment points on the side of the carrier frame. Normally there is no slack in the pendant 21 or in the tension cables 29, and therefore the beam 28 is normally maintained at a fixed distance above the top of the counterweight 19 on the carrier 18.

When lifting forces on the counterweight carrier raise it off of the ground to a predetermined distance, those forces are imposed upon the crane chassis 5 through a rigid lost motion connection between the counterweight carrier and the platform, so that the crane chassis then cooperates with the counterweight carrier to resist tilting forces on the boom.

That lost motion connection, which is described below, acts upon the crane chassis, in the embodiment here illustrated, through a pair of parallel rearwardly and upwardly inclined gantry legs 31 that have their lower ends secured to the platform, as at 34, at a location forward of the vertical axis and above the level of the hoisting machinery 11. Each of these gantry legs 31 is supported in its rearwardly and upwardly inclined attitude by means of a rigid substantially upright strut 35 that is connected at its lower end to the platform 7 and has its upper end connected to the gantry leg 31 near the upper end of it. The gantry comprising the legs 31 and the struts 35 is a conventional structure in a crane of the general type here under consideration, whether or not the crane is intended for use with a mobile counterweight carrier. When such a crane is equipped with a counterweight carrier according to the principles of this invention, the gantry functions only during erection of the crane, and when the crane is in operation lines (not shown) which are trained around sheaves (not shown) on that gantry are normally slack.

The above-mentioned lost motion connection, as here illustrated, comprises a pair of telescoping struts 32, one for each gantry leg 31, which extend parallel to one another and are connected between the lifting beam 28 and the upper ends of their respective gantry legs 31, and a pair of tension cables 33, one at each side of the crane chassis, each connected between the lifting beam 18 and the platform.

Figure 4:
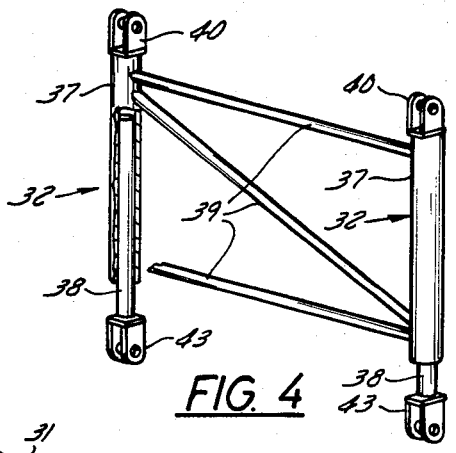
FIG. 4 is a detail perspective view, with portions shown broken away, of the structure providing a lost motion connection between the crane deck and the counterweight carrier.
Figure 3:
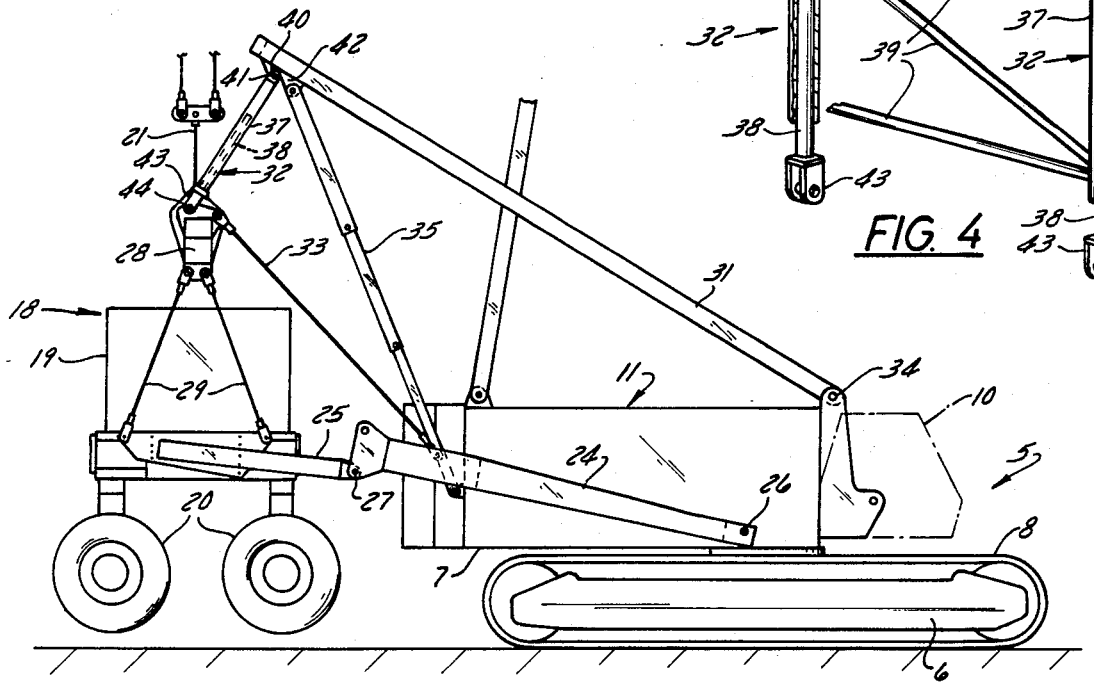
FIG. 3 is a view generally similar to FIG. 2 but illustrating conditions when the crane is hoisting a heavy load.

Each of the telescoping struts 32 comprises a outer tube 37 and a smaller diameter inner tube 38 that is received within the outer tube. The outer tubes 37 of the two telescoping struts are connected by transverse tie members 39 (FIG. 4) by which they are rigidly confined in parallel relation to one another, spaced apart by a distance substantially equal to the spacing between the gantry legs 31. A clevis 40 on the upper end of each outer tube 37 provides for its pivotal connection, as at 41, to a bracket 42 on the upper end portion of the gantry leg, which bracket also provides for connection to that gantry leg of its supporting strut 35. Each of the inner tubes 38 has a clevis 43 on its bottom end that provides for its pivotal connection 44 to a bracket on the lifting beam 28 and which also serves as an upwardly facing abutment against which the bottom end of the outer tube engages when the telescoping strut is in its fully contracted condition. Said bottom end of the outer tube 37 defines a downwardly facing abutment that is in an opposed position relative to the abutment on the inner tube 38. The pivotal connection 44 of the telescoping strut to the lifting beam defines a horizontal axis which is contained in a vertical plane that also contains the center of gravity of the mass comprising the counterweight carrier and the counterweight.

The tension cables 33 that comprise a part of the lost motion connection between the platform and the counterweight carrier have upper ends connected to the same brackets that connect the telescoping struts 32 to the lifting beam 28. The lower end of each cable 33 is connected to the gantry strut 35 at its side of the crane chassis, just above the lower end of that strut. These cables are of such length that they are slack when the counterweight carrier is resting on the ground but are fully tensioned when the telescoping struts 32 are fully contracted, so that they then define a rearward limit of swinging of the telescoping struts 32 about their pivotal connections 41 to the gantry legs 31. Preferably they constrain the connections 44 between the telescoping struts 32 and the lifting beam 28 to remain in the above mentioned vertical plane that contains the center of gravity of the counterweight carrier mass. Thus, when the counterweight carrier is lifted to a predetermined height above the ground, the tensioned cables 33 cooperate with the fully contracted telescoping struts 32 to provide an effectively rigid connection between the counterweight carrier and the platform 7 through which tilting forces on the boom 12, carried through the pendant 21, are imposed upon the crane chassis. It is noteworthy that when the cables 33 are of the correct length, there is no need for any adjustment of the lost motion connection between the counterweight carrier and the crane chassis, and the operation of that connection is completely automatic.

Preferably the lost motion connection becomes effective when the counterweight carrier has been lifted to a height of four to six inches above the ground, so that the crane as a whole can move over substantial irregularities in the ground without excessive loads being imposed upon the tires of the counterweight carrier wheels 20. If the counterweight carrier moves onto a low spot, in the course of travel over an irregular surface, the telescoping struts 32 will extend and the slack in the tension cables 33 will increase, with the result that the mast 13 and the boom 12 will swing back correspondingly, but with no other consequences. If the unloaded crane is to be moved over a surface with large irregularities, so that the telescoping struts 32 may be fully contracted by the lifting forces imposed upon the trailer by high spots, the boom can be lowered to an angle on the order of 65° to provide good forward stability of the boom and mast. Normally, blocks (not shown) will be inserted between the counterweight 19 and the lifting beam 28, to prevent dithering of the boom, but for movement over a very rough surface these blocks can be removed to allow for further rise of the counterweight carrier chassis before the telescoped struts 32 bottom and force the tires of the counterweight carrier to carry a part of the weight of the crane chassis.

From the foregoing description taken with the accompanying drawings it will be apparent that this invention provides a crane of the type having a crane chassis on which a platform is swivelable and a trailer-like counterweight carrier that is constrained to move horizontally with the chassis but is movable up and down relative to it, wherein there is a lost motion connection between the counterweight carrier and the platform that allows the counterweight carrier mass to be supported on its own wheels when the crane is unloaded, so that the counterweight carrier then imposes no tilting force upon the swivel connection between the platform and the crane base, and which allows the counterweight carrier mass, unaided, to support forward tilting forces imposed upon the boom by normally heavy loads but causes the crane chassis to cooperate with the counterweight carrier in supporting the tilting forces imposed upon the boom by extra heavy hoisting loads, said connection being fully automatic in operation and requiring no adjustment.

What is claimed as the invention is:

1. A crane of the type comprising a crane base upon which a platform is mounted for swiveling about a vertical axis, rigid upwardly projecting load supporting means on said platform comprising a boom which is normally inclined forwardly and from the top of which a load line depends and a mast behind the boom that is normally inclined rearwardly, a counterweight carrier mounted on wheels and carrying a counterweight, rearwardly extending arm means, pivot means mounting said arm means on said platform for movement about a horizontal axis, forwardly extending arm means fixedly mounted on said counterweight carrier, means pivotally connecting respective adjacent ends of said forwardly and rearwardly extending arms for movement about a horizontal axis whereby said counterweight carrier is maintained in rearwardly spaced relation to the platform and constrained to move horizontally with it but is allowed to move up and down relative to it, and guy means connected with the counterweight carrier and with the tops of the boom and the mast for translating into a lifting force on the counterweight carrier the forward tilting force imposed upon the boom by a load supported by said load line, said crane being characterized by:

means providing a lost motion connection between the counterweight carrier and the platform that allows the counterweight carrier to move relative to the platform up to and down from a predetermined limit at which its said wheels are spaced above the level of the bottom of the crane base, the last mentioned means comprising a pair of rigid members, (1) horizontal pivot means connecting one of said member to the counterweight carrier and providing a substantially upwardly facing abutment, and (2) horizontal pivot means connecting the other member of said pair to the platform and providing a substantially downwardly facing abutment that is engaged by said upwardly facing abutment upon movement of the counterweight carrier up to said limit and whereby forces that tend to lift the counterweight carrier above said limit are imposed upon the platform and cable means connected between said platform and counterweight carrier for transferring the lifting forces imposed on the counterweight to said platform in response to engagement of said abutments.

2. The crane of claim 1 wherein said horizontal pivot means connecting the other member of said pair is a gantry mounted on said platform that comprises a rearwardly and upwardly inclined leg having a rear end portion near the counterweight carrier, further characterized by:

(1) said pair of rigid members being in telescoped relationship (a) said one of the pair of rigid members having a pivotal connection with the counterweight carrier about which it is swingable forwardly and rearwardly and which is spaced below said upwardly facing abutment, and (b) said other rigid member having a pivotal connection to said rear end portion of the gantry leg about which it is swingable forwardly and rearwardly and which is spaced above said downwardly facing abutment; and (2) normally slack cable means (a) having one end connected with the counterweight carrier near its pivotal connection with said one rigid member and (b) having an opposite end connected with said platform at a level substantially below its said one end, said cable means having a length to be tensioned when said abutments are engaged, to then confine said rigid members against swinging about their said pivotal connections and cooperate with them in imposing upon said platform forces that tend to lift the counterweight carrier above said limit.

3. A crane of the type comprising a crane base upon which a platform is mounted for swinging about a vertical axis and having a mast and a boom supported by said platform and projecting upward from it, the boom being normally inclined forwardly and having a load line depending from its top and the mast being behind the boom and normally inclined rearwardly, said crane also comprising a counterweight carrier mounted on wheels and carrying a counterweight, rearwardly extending arm means, pivot means mounting said arm means on said platform for movement about a horizontal axis, forwardly extending arm means fixedly mounted on said counterweight carrier, means pivotally connecting respective adjacent ends of said forwardly and rearwardly extending arm for movement about a horizontal axis whereby said counterweight carrier is maintained in rearwardly spaced relation to the platform and is constrained to move horizontally with it but is allowed to move up and down relative to it, and guy means connected with the counterweight carrier and with the tops of the boom and the mast for translating into a lifting force on the counterweight carrier the forward tilting force imposed upon the boom by a load supported by said load line, said crane being characterized by:

a pair of rigid telescoping members, one connected with the counterweight carrier and the other connected with the platform, a portion of said respective members defining opposing abutments that are engaged by movement of the counterweight carrier upward relative to the platform to a predetermined limit at which the counterweight carrier is supported only by said lifting force, said rigid members providing a lost motion connection between the counterweight carrier and the platform whereby forces that tend to urge the counterweight carrier upward beyond said limit are imposed upon the platform, said rigid members having horizontal pivotal connections with the counterweight carrier and with the platform, respectively, about which they are pivotable forwardly and rearwardly, said one member having its said abutment facing downwardly and spaced above its pivotal connection with the counterweight carrier and said other member having its said abutment facing downwardly and spaced below its pivotal connection with the platform;

and cable means having a first end connected with said platform at a low level and having a second end connected with said counterweight carrier near said horizontal pivotal connection of said other rigid member and at a substantially higher level than said low level, said cable means having a portion between said first and second ends that is normally slack but which is tensioned upon engagement of said abutments and which then confines said rigid members against pivotal movement and in response thereto transfers to the platform the lifting forces imposed upon the counterweight carrier.

* * * * *